United States Patent [19]

Fritz

[11] 3,941,995

[45] Mar. 2, 1976

[54] FLUORESCENT LIGHT FOR MOBILE HOMES

[75] Inventor: Thomas W. Fritz, East Petersburg, Pa.

[73] Assignee: Armstrong Cork Company, Lancaster, Pa.

[22] Filed: July 14, 1972

[21] Appl. No.: 271,740

[52] U.S. Cl. ..... 240/51.11 R; 240/7.35; 240/7.4

[51] Int. Cl.[2] ..... H05B 33/02

[58] Field of Search ..... 240/51.11 R, 9 R, 7.35, 240/7.4

[56] References Cited

UNITED STATES PATENTS

| | | | |
|---|---|---|---|
| 2,346,315 | 4/1944 | Levey | 240/7.35 |
| 2,372,874 | 4/1945 | Zimmerman | 240/7.35 |
| 3,549,879 | 12/1970 | Meyer | 240/51.11 R X |

*Primary Examiner*—R. Moses

[57] ABSTRACT

The fluorescent light fixture herein has been designed especially for installation in the roof cavity of a mobile home. The reflector and support bracket are of a proper dimension to fit between roof rafters spaced 16 inches on center. Adequate height is maintained for the reflector and bracket to allow installation in the limited attic space of a mobile home. A lens structure is provided to cover the lighting fixture assembly.

3 Claims, 4 Drawing Figures

Fig. I
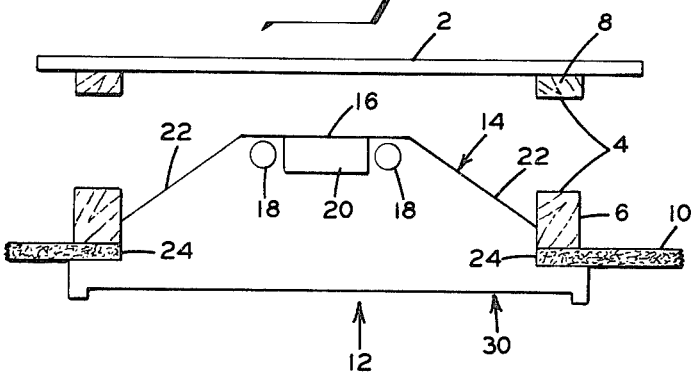
Fig. II
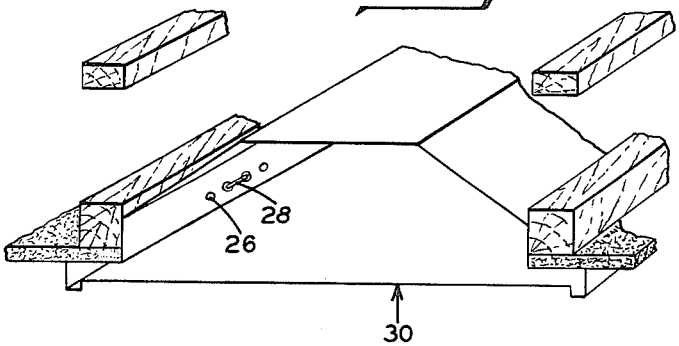
Fig. IV
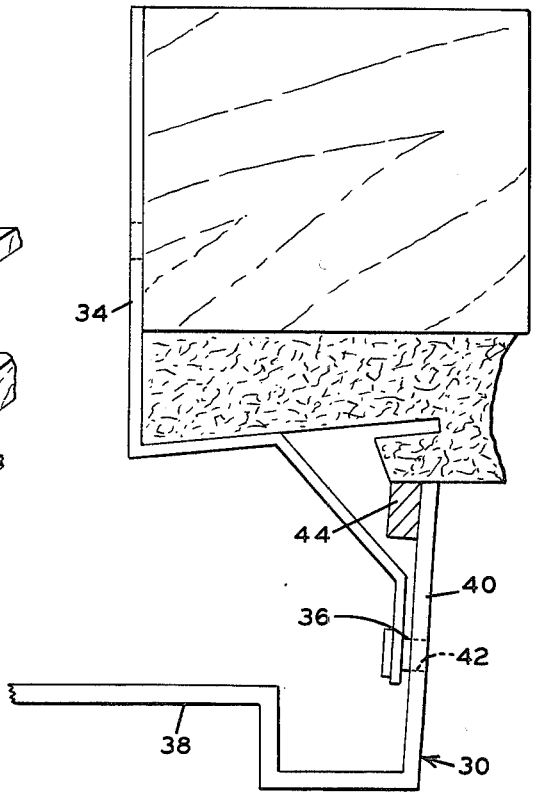
Fig. III
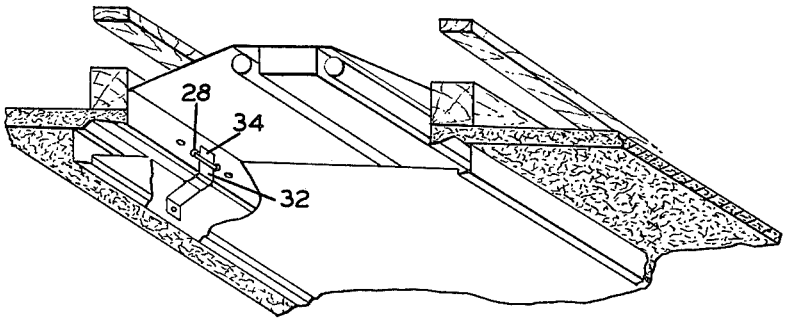

FLUORESCENT LIGHT FOR MOBILE HOMES

BACKGROUND OF THE INVENTION

1. Field of the Invention

The invention herein is a lighting fixture and, more specifically, a lighting fixture for mobile homes.

2. Description of the Prior Art

To date, in most cases, mobile homes have not been provided with ceiling type lighting fixtures. If ceiling type fixtures were ever provided, they would be the conventional incandescent bulb type lighting fixture which is normally covered by a glass circular lens. In certain areas of a mobile home, and in particular the kitchen area, a fluorescent light would be a very desirable addition to the mobile home. However, generally due to the low height of mobile home ceilings, a fluorescent light fixture which extends from the ceiling of the mobile home would project downwardly into the room area to such an extent that tall people would be in danger of striking the lighting fixture. Also, fluorescent lights always give a better appearance when they are built into a ceiling structure.

Many different fluorescent light fixtures are available on the open market. Many are specifically designed for use in suspended ceiling systems. Others are designed to be mounted upon walls or in other areas. However, no fluorescent lighting fixture on the market today is particularly adaptable for use between the rafter structures of a mobile home ceiling.

It is the primary object herein to provide a fluorescent lighting fixture which is specifically designed for use in a mobile home ceiling to provide a built-in fluorescent light fixture in the ceiling of the mobile home.

SUMMARY OF THE INVENTION

The lighting fixture is provided with a conventional reflector structure which has on the edges thereof a support bracket for mounting the reflector structure in position. Staples pass through the support bracket and hold the reflector in position between two adjacent roof rafters of a mobile home roof cavity. Built into the reflector structure is the mounting for the fluorescent tubes and the electrical control network for operating the tubes. Lens clips are provided for the fastening of a lens over the downward open area of the reflector structure. Proper gasketing around the lens frame and the choice of a lens material with a low permeance to water vapor will effectively prevent the migration of water vapor into the mobile roof cavity.

BRIEF DESCRIPTION OF THE DRAWING

FIG. I is a side view of a mobile home roof structure with the light fixture mounted therein;

FIG. II is a perspective view of the structure of FIG. I;

FIG. III is another perspective view of the structure of FIG. I showing the lens clip mounting; and FIG. IV is an enlarged side view of the lens mounting structure.

DESCRIPTION OF THE PREFERRED EMBODIMENT

A conventional mobile home ceiling structure is shown in FIG. I. The outside roof sheathing 2 is supported on roof trusses 4 which are composed of the lower chord member 6 and an upper chord member 8. The trusses are placed 16 inches on center in the mobile home structure, and the trusses provide an area which is about 6 inches deep between the roof sheathing and the ceiling board structure 10 which is placed on the inside of the mobile home ceiling. Into this area it is desired to place a fluorescent light fixture assembly 12 which can provide adequate illumination to the area below the ceiling 10.

The light fixture assembly 12 is composed of a reflector structure 14 which is generally in the shape of an inverted truncated cone. The base of the cone is an open area through which light will pass to illuminate the area below the ceiling board 10. The truncated portion 16 of the cone is generally in a plane parallel with the plane of the roof sheathing and ceiling board. On the surface 16, there are mounted the fluorescent tubes 18 and a housing 20 into which is placed the appropriate wiring for operating the fluorescent tubes 18. The sloping sides 22 of the reflector 14 actually function as the reflectors which direct light downwardly into the area below the plane of the ceiling board structure 10. On the ends of the inclined reflector sides 22, there are positioned support brackets 24 which are used to mount the reflector and in effect the total fluorescent lighting fixture assembly 12 in position within the cavity between two adjacent trusses of a mobile home ceiling.

The support bracket structure 24 is basically an L-shaped structure with the long leg of the L resting up against the side of the lower chord 6 of the roof truss 4 while the short leg of the L structure rests up against the ceiling board structure 10 to properly position the lighting fixture within the roof cavity relative to the plane of the ceiling board. In normal practice, the support bracket structure would be nothing more than an extension of the reflector side structure 22 which has simply been bent into the particular shape necessary to fit it between the two lower chords of adjacent roof trusses. The support bracket structure is provided with spaced hole means 26. The holes are spaced about one inch apart so that a conventional 1 inch staple can be driven through two adjacent holes into the lower chord of a roof truss positioned behind the support bracket. Consequently, staples are used to mount the reflector and support bracket assembly into place in the mobile home roof cavity.

FIG. II provides a perspective showing of the reflector and support bracket assembly in position within the roof cavity with the staple 28 passing through two adjacent hole means 26 to fasten the support bracket assembly to the lower chord of the roof truss of the mobile home ceiling. A lens assembly 30 will then be mounted over the downwardly opening cavity of the reflector assembly to provide a more pleasing external appearance to the lighting fixture. The lens assembly will not only cover up the inner portions of the light fixture, which are not particularly pleasing to view, but also the lens will tend to diffuse the light coming from the fluorescent tubes of the lighting fixture. The lens will be made slightly larger than the overall size of the cavity within the mobile home roof which receives the lighting fixture so that the lens will cover over the edges of the bracket assembly and the raw edges of the ceiling board that may exist.

In FIG. III, there is shown a perspective view of the lighting fixture in position with a lens clip structure 32 which is utilized to hold the lens in position. The lens clip structure is basically a Z-shaped element with one leg of the Z being mounted adjacent the long side of the support bracket structure 24 and the other leg of the Z having means for fastening the lens to the light fixture. Normally, the lens clip is made from a resilient piece of metal which is slightly less than 1 inch in width. The clip is positioned with its leg 34 adjacent the support bracket and between two adjacent hole means 26 in the support bracket. A staple is then passed through the two adjacent hole means. This staple now not only holds the support bracket in position relative to the lower chord of the roof truss, but the body part of the staple now presses against the leg 34 of the lens clip 32 and holds it in position relative to the support bracket and, in turn, relative to the roof truss. Thus, there is provided a very simple way of fastening the lens clip in position. On the opposite end of the lens clip there is provided a projection 36.

The lens structure 30 is normally made with a bottom 38 which is normally placed parallel to the plane of the ceiling boards 10. Then short sides 40 are provided on the lens 30, and these generally extend perpendicular from the plane of the flat bottom 38. The edges of the sides are placed against the ceiling board and will transmit some light through the side of the lens structure. On the sides 40 there is placed a hole means 42 which has inserted into it the projection 36 of the lens clip. This will hold the lighting fixture lens 30 in position relative to the plane of the ceiling board. It is obvious other ways could be used to mount the lens.

Because mobile homes are particularly susceptible to the problem of the passage of moisture vapor into the roof cavity where it will condense upon the cold outer sheathing of the roof and then drip down upon the ceiling boards to damage them, it is necessary that the lighting fixture have a very low permeance to moisture vapor. Normally, the ceiling boards are provided with coatings or backings which help to prevent the passage of water vapor therethrough. The choice of lens material, such as a conventional plastic lens material, will provide a lens which has a very low permeance to the water vapor and thus will effectively prevent the migration of water vapor into the mobile home cavity. By the provision of a gasketing means 44 adjacent the point where the side 40 of the lens engages the overlying ceiling boards, it will be possible to prevent the migration of moisture at this juncture. Actually, since the sides of the lens structure extend around all four sides of the bottom area 38 of the lens, a gasket structure would also be provided all the way around the lens structure.

What is claimed is:

1. A lighting fixture assembly which is particularly adapted to be mounted between the trusses of a roof structure and particularly adapted for use in a mobile home structure, the combination of a mobile home roof truss structure which is provided with an upper plane containing external roof sheathing and a lower plane containing internal ceiling boards, a fluorescent lighting fixture mounted within a roof cavity defined by two adjacent roof trusses and the overlying roof sheathing, said fluorescent light fixture assembly constituting a reflector structure which extends between two adjacent roof trusses and carries the fluorescent lights and their operating components, support bracket means connected to the reflector means and connecting the reflector means to the roof trusses, a lens structure mounted to overlie the fluorescent lighting fixture assembly, said support bracket means being provided with hole means into which staples are placed to mount the support bracket means in position relative to the roof trusses, and a lens clip structure is positioned adjacent to the hole means and held in position by staple means passing through the hole means and against the lens clip, said lens clip in turn holding the lens assembly in position relative to the lighting fixture assembly.

2. The apparatus of claim 1 wherein the staple means is composed of two leg members and an interconnecting body member, said leg members passing through the hole means and the body member of the staple means engages the lens clip to hold it in position against the support bracket means of the lighting fixture assembly.

3. A lighting fixture assembly which is particularly adapted to be mounted between the trusses of a roof structure and particularly adapted for use in a mobile home structure, the combination of a mobile home structure with a roof truss structure which is provided with an upper plane containing external roof sheathing and a lower plane containing internal ceiling boards, a fluorescent lighting fixture mounted within a roof cavity defined by two adjacent roof trusses and the overlying roof sheathing, said fluorescent light fixture assembly constituting a reflector structure which extends between two adjacent roof trusses and carries the fluorescent lights and their operating components, support bracket means connected to the reflector means and connecting the reflector means to the roof trusses, a lens structure mounted to overlie the fluorescent lighting fixture assembly, a gasketing means is provided adjacent the point where the lighting fixture structure is mounted relative to the ceiling boards and the lens is made of a material which has low permeance to water vapor so that the lens and gasketing will prevent the migration of water vapor into the roof cavity structure between two adjacent trusses.

* * * * *